US007600562B2

(12) United States Patent
Christian

(10) Patent No.: US 7,600,562 B2
(45) Date of Patent: Oct. 13, 2009

(54) NON-EXPLOSIVE TUBING PERFORATOR AND METHOD OF PERFORATING

(76) Inventor: J.B. Christian, 26 Holly Lake Rd., Ellisville, MS (US) 39437-4223

( * ) Notice: Subject to any disclaimer, the term of this patent is extended or adjusted under 35 U.S.C. 154(b) by 111 days.

(21) Appl. No.: 12/072,007

(22) Filed: Feb. 22, 2008

(65) Prior Publication Data

US 2009/0211745 A1 Aug. 27, 2009

(51) Int. Cl.
*E21B 43/11* (2006.01)

(52) U.S. Cl. ..... 166/55.3; 166/55.1; 166/298

(58) Field of Classification Search ..... 166/55.3
See application file for complete search history.

(56) References Cited

U.S. PATENT DOCUMENTS 2,426,106 A * 8/1947 Kinley ..... 166/55.1
4,566,544 A 1/1986 Bagley et al.
4,624,307 A 11/1986 Kinley
4,632,034 A 12/1986 Colle, Jr.
5,148,868 A 9/1992 Christian

* cited by examiner

*Primary Examiner*—David J Bagnell
*Assistant Examiner*—Catherine Loikith

(57) ABSTRACT

An improved perforating apparatus that creates drain holes in well tubing without the use of explosives. A hydraulically-activated apparatus created from machined metal pipes and solid metal bars that form four main sections, a hollow metal pipe 10, hollow metal chamber 11, wedge holder 12, and a wedge stop 13. A drive disc 14, drive wedge 15, piston 16, metal button 17, shear screws 19, and wedge holder O-rings 20, a drive disc O-ring 21, a piston O-ring 30, and a wedge stop O-ring 31 complete and seal the apparatus. When perforating apparatus reaches a location to be perforated, an impact bar is manually-dropped into tubing string and hits top of the apparatus. The force of well fluid pressure on a drive disc 14 within the apparatus forces drive wedge 15 inside drive holder 12 to impact piston 16. Impact on piston 16 expels button 17 through well tubing, creating a drain hole.

4 Claims, 3 Drawing Sheets

NON-EXPLOSIVE TUBING PERFORATOR AND METHOD OF PERFORATING

BACKGROUND

1. Field of the Invention

The present invention relates to a perforating apparatus, specifically for perforation of well tubing to drain fluid.

2. Description of Prior Art

The present invention relates to methods and apparatus for perforating tubing inside a subsurface well, and more specifically to manually-dropped perforating assemblies for use in perforating tubing inside a well.

The present inventor was granted U.S. Pat. No. 5,148,868 Christian (1992), for a manually-dropped perforating assembly that uses an explosive charge within a percussion firing assembly. U.S. Pat. No. 5,148,868 is machined from cylindrical lengths of metal pipe and includes a firing pin disposed within said perforating assembly. When firing pin is in an armed position and subjected to sharp force it strikes a detonator in a shell holder. Other known perforating assemblies also use explosive charges.

In today's environment, use of explosive charges, however small, is not welcome in the oilfield due to liability issues and restrictions on methods of transporting explosives. For example, transporting heretofore known perforators to offshore wells by air is prohibited.

Drilling wells has been fairly standard, that is, a hole is drilled and casing is installed and tubing is placed inside the casing to convey the production to the surface. The uses of perforators in the drilling of wells and in the servicing of wells already in production are manyfold. Certain types of perforators are used to perforate holes in casing in order to start production. Such perforators are lowered to the firing point using one of three methods: lowered by an electric wireline, lowered by a slickline, or attached to the end of tubing and lowered through the casing. The latter is generally referred to as a tubing-conveyed perforator or gun. Perforators of casing are fired by an electrical firing system; by use of a drop bar, commonly referred to as a "go devil" system; or some type of hydraulic system. The expended perforator is then returned to the surface using one of the following methods: by an electric wireline, by a slickline, or pulled to the surface along with the tubing string. And, in some cases, the perforator is released into the bottom of the well and left in an area of the wellbore below the production zone called the rat hole.

Occasionally, casing perforators are used to create a borehole at a precise depth in the tubing in order to enhance production. Casing perforators are rarely used to perforate both tubing and casing.

Use of perforators for other than drilling operations is for servicing producing wells. Frequently, it is necessary to perforate the tubing, within a well casing, so that trapped fluids can drain and escape from the tubing prior to pulling the tubing string from a well. Wells with plugged tubing require the tubing string to be pulled from the well. Therefore, inventors created perforating guns designed to make drain holes in the tubing, but not the casing, through use of a controlled explosion. Explosive perforating guns, such as that disclosed in U.S. Pat. No. 4,624,307 to Kinley et al (1986), have been used to penetrate tubing.

Prior to a patent of the present inventor, U.S. Pat. No. 5,148,868, to Christian (1992), all known tubing perforators used for creating drain holes in tubing were lowered into firing position by means of a wireline; either an electric wireline or a slickline. After detonation, such perforators must be retrieved from the well before the tubing string can be pulled from the well. It is only after the tubing is pulled that the necessary steps can be taken to get the well back into production.

It is also possible to pull tubing from a well without draining the fluids from the tubing. And, pulling tubing without a drain hole is less costly than using a perforator which must be lowered by wireline. Several problems can occur when tubing is pulled without a drain hole. The time required to pull tubing from a hole is increased due to the problem of trying to contain the fluids trapped in the tubing. A bucket designed to wrap around the connections of the tubing can be used. A hose is attached to the bottom of the bucket at one end with the other end attached to a tank which is mounted on a truck. When a tubing string section is unscrewed from another section, the fluids trapped inside flow into the tank. Some of the fluids invariably spill onto the surface. Clean up of such spillage is mandated by state regulation, and when contamination occurs outside the location of the well, clean up is mandated by the Environmental Protection Agency.

The following is a description and the disadvantages of these various known methods of perforating tubing:

U.S. Pat. No. 5,148,868 to Christian, Sep. 22, 1992, discloses a method and apparatus for perforation of well tubing that incorporates a mechanically detonated firing head. An explosive charge is required to create a drain hole through well tubing, so U.S. Pat. No. 5,148,868 creates a drain hole with the use of explosives. The apparatus described can be dropped by hand, eliminating use of electric wireline or slickline operations to lower and to retrieve the apparatus. The method used to lower and to retrieve the present invention is the same as U.S. Pat. No. 5,148,868. The difference is an explosive charge, which could prematurely detonate, required to use U.S. Pat. No. 5,148,868, is not required to use the present invention. And, another difference is the design of the apparatus disclosed is more complex than the present invention.

U.S. Pat. No. 4,911,251 to George, et al., Mar. 27, 1990, discloses a method and apparatus for actuating a tubing-conveyed perforating gun, utilizing a firing head and two pistons, one releasable through mechanical force and the other through hydraulic force. The method disclosed requires initiating a burn or an explosion to detonate a perforating gun lowered into well tubing using a wireline or slickline. George et al. does not allow use of a perforating apparatus without a burn or explosives which are safety issues. George et al. does not allow use of a perforating gun without the time-consuming and malfunction-prone use of a wireline or slickline.

U.S. Pat. No. 4,624,307 to Kinley et al., Nov. 25, 1986, discloses an explosive perforating tool conveyed by wireline or slickline and consisting of numerous parts. Kinley does not allow creating drain holes without the use of dangerous explosives, and its complex design is prone to malfunctioning. The method described in U.S. Pat. No. 4,624,307 to lower and raise the perforating tool requires the time-consuming use of an electric wireline or slickline; methods prone to malfunctioning.

U.S. Pat. No. 4,632,034 to Colle, Jr., Dec. 30, 1986, discloses redundant detonation initiators for use in wells; and methods and apparatus for detonating high explosive devices downhole in a well. Colle, Jr. does not allow creation of drain holes without the use of dangerous explosives.

U.S. Pat. No. 4,566,544 to Bagley, et al., Jan. 28, 1986, discloses a drop bar firing system for a tubing-conveyed armed perforating gun; a drop bar that contacts a firing head. Bagley does not allow creation of drain holes in tubing without use of dangerous explosives.

Unlike prior art, the present invention, a non-explosive perforating apparatus, is safe to use because no detonator and no shell is required. There are several reasons the present invention is less costly to manufacture, use, and redress than heretofore known wireline and slickline perforators.

The present invention does not require a license from the Bureau of Alcohol, Tobacco, Firearms, and Explosives (ATF) to store, transport and use because no explosive charge is required. Adherence to special handling and special storage regulations mandated by ATF is not required.

The present invention can be shipped abroad which is not possible with heretofore known perforators due to U.S. Department of Homeland Security restrictions.

The present invention is a simple design, so its manufacture, use, and redressing is less complex than heretofore known perforators.

The present invention does not require multiple moving parts, so the possibility of a malfunction delaying a successful perforation is extremely low.

The present invention can be manually dropped into well tubing from the surface, so its use does not require a wireline truck, and two workers a wireline operator and a helper.

The present invention permits the removal of tubing string with no time-consuming separate step required to retrieve it.

3. Disadvantages of Prior Art

Thus, heretofore known methods and devices for perforating tubing suffer from a number of disadvantages as set forth below along with reasons the present invention is superior. The following details these disadvantages and provides the reasons this non-explosive, manually-dropped perforator with two methods of activation, hydraulically-activated or fluid-activated, is totally safe and much less costly to use:

(a) Workers can be injured when handling and using a wireline or slickline perforator because required explosive charge can detonate prematurely. This invention does not require an explosive charge, so is safe to use.

(b) With the use of heretofore known perforators of complex design, more frequent malfunctions result because a large number of parts are required which leads to time-consuming repairs, more costly manufacture, and wireline operator training. The present invention is not a complex design so requires minimal repairs, lower manufacturing and redressing costs; and no special worker training costs.

(c) With the use of an electrically-detonated wireline perforator, workers can be injured when premature firing occurs due to electrical interference, such as radio waves. The present invention is hydraulically- or fluid-activated, so premature activation cannot occur.

(d) A second perforator may need to be lowered when a firing head on a wireline-conveyed perforator malfunctions, a problem which occurs because the firing heads are comprised of several moving parts. This is not a problem with the present invention because it has no firing head and is designed to be activated with two moving parts when using a drive-wedge method of activation, and with one moving part when an alternative fluid-method of activation is used, not requiring a wedge.

(e) Wireline perforators cannot be retrieved from a well along with the well tubing string. The present invention is designed so that extra steps are not required to retrieve the apparatus.

Prior art does not provide an apparatus that can be activated without an explosive charge and does not provide a system of such noncomplex, trouble-free design.

SUMMARY OF THE INVENTION

In the preferred embodiment, using the hydraulically-activated method, the non-explosive perforating apparatus is comprised of machined metal pipes and machined metal bars and a piston, metal button, O-rings and shear screws. Activation, when the apparatus reaches a location to be perforated, is from pressure from the fluid in a well. A manually-dropped impact bar exerts force on a drive disc at the top of the apparatus, shearing screws which allows disc to release down onto a drive wedge. The force created by hydraulics moves drive disc on drive wedge inside a wedge holder which impacts a piston. The impact on the piston causes a metal button to be expelled from the chamber wall and through the tubing, which creates a drain hole in tubing.

In an alternative method of activation, the non-explosive perforating apparatus does not require a drive wedge; the apparatus is fluid-activated. With this method, the force of the drive disc is exerted on fluid inside the wedge holder. Following impact on the piston the apparatus operates in the same manner as the primary embodiment of the apparatus; the impact on the piston causes a metal button in the wall of the apparatus to be pushed through well tubing to create a drain hole in the tubing.

The present invention comprises a perforating apparatus that creates a drain hole in tubing without the use of an explosive, such as a Jet charge and detonator, and other propellant methods governed by the Bureau of Alcohol, Tobacco Firearms and rules and regulations of other governmental agencies such as Homeland Security. The present invention is activated by an impact bar dropped by hand to hit the top of a perforating apparatus. In the preferred embodiment, the body of the apparatus is sealed with O-rings and frangible pins and consists of:

machined hollow metal pipe,
machined hollow metal chamber,
wedge holder, a machined metal bar
wedge stop, a machined metal bar Inside the body of the apparatus are the following machined metal parts:

drive disc,
drive wedge,
piston, and
button.

The present invention has an outside diameter that permits it to be manually dropped into a tubing string in a well allowing it to reach the appropriate point, typically a pump or an obstruction, in a matter of minutes. It can take hours to lower a perforator to the appropriate point in a well when using wireline or slickline perforating methods.

Unlike wireline and slickline perforators, the present invention is a perforating apparatus does not need to be retrieved from a well before a tubing string can be pulled from the well. Tubing string can be pulled from a well immediately after activation. The apparatus, though unattached, rides within the tubing on top of a pump or plug when tubing string is pulled from a well and is retrieved from within the tubing after the tubing string reaches the surface.

Alternative Embodiments

Providing further objects and advantages of the Non-Explosive Tubing Perforator, another approach to sealing the bottom end of the apparatus is use of a bull plug placed at the bottom of the wedge stop. The plug is fitted with two or more O-rings to secure a tight seal. The bull plug is threaded at the bottom to permit weights to be attached when circumstances require the perforating apparatus to have added weight.

In another embodiment, an alternative fishing neck is drilled and threaded at its bottom. This fishing neck screws onto the top of the perforating apparatus and is adapted to receive on its top the impact from a dropped impact bar. The fishing neck allows for suspension of the apparatus from a wireline to provide added versatility of use if an unusual circumstance arose that required a wireline.

In another embodiment of the method of use, the perforating apparatus can be pointed downward when dropped from the surface. Activation will occur when apparatus hits a pump or obstruction inside a tubing string. Removal of assembly from a well occurs in the same manner as in the embodiments previously described.

ADVANTAGES OF THIS INVENTION

The object of the present invention is to create a drain hole in a tubing string in a well using a non-explosive method, either a hydraulic or a fluid method of activation, to perforate tubing. A manually-dropped impact bar exerts force on the top of the perforating apparatus that shears screws allowing a drive disc to release down on a drive wedge or fluid. Activation occurs from pressure from fluid in the well which impacts a piston causing a metal button to be pushed through the tubing creating a drain hole in the tubing without the use of dangerous explosives.

Accordingly, besides the objects and advantages of the Non-Explosive Tubing Perforator previously described, several objects and advantages of the present invention are to provide:

(a) A non-explosive tubing perforator with activation methods using either the force of a drive disc hitting a drive wedge, or a drive disc hitting fluid, inside a wedge holder, thus alleviating the danger to workers when a perforator requiring an explosive charge is prematurely detonated. The present invention is safe and easy to store, transport, and use.

(b) A non-explosive tubing perforator simply designed resulting in greater reliability, ease of activation, and only minimal worker training. The present invention requires few repairs, is less costly to manufacture, redress, store, transport, and use.

(c) A non-explosive tubing perforator utilizing mechanical methods of activation alleviating any dangerous premature firing due to electrical interference. The present invention is safe to use.

(d) A non-explosive tubing perforator of noncomplex design requiring a drive disc and drive wedge, or fluid inside a wedge holder, for activation; alleviating the need to lower a second perforator due to a malfunction of the first. The present invention is efficient and cost effective.

(e) A non-explosive tubing perforator retrieved from a well along with the well tubing string, alleviating extra steps to raise the apparatus. The present invention is a time-saving, cost effective method of perforating tubing.

Objects and Advantages

Accordingly, besides the objects and advantages of the non-explosive tubing perforating apparatus and its methods of use previously described, several objects and advantages of the present invention are:

Because this manually-dropped non-explosive perforator is activated due to hydraulics, the pressure from the fluid in a well, or alternatively fluid-activated, it is safe to use, transport, and store, unlike perforators requiring detonators and charges.

The danger to workers transporting, arming, using, and storing perforators requiring explosive charges does not exist.

No ATF, or other legally-mandated rules and regulations relevant to handling of explosives, pertain to the present invention.

The present invention does not require safety training, and the expense of legally-mandated storage magazines is not required.

The present invention can be transported without regard to explosives regulations, such as those prohibiting transporting by helicopter to off-shore oil well platforms.

Given the simplicity of its design with few moving parts, it is significantly less costly to manufacture and redress than heretofore known perforators.

Draining fluid from tubing before tubing is pulled from a well eliminates the problem of contamination of the soil from spilling fluids onto the ground at the surface, thus eliminates the time-consuming, and therefore costly, legally-mandated clean up.

Getting wells back into production as quickly as possible is extremely important. Due to the demand for oil, oil producers can suffer significant financial loss when wells are out of production. Because, this non-explosive perforating apparatus is safer and takes less time and less labor to use, it is a more efficient and less costly method of draining fluid from well tubing.

OBJECTS OF THE INVENTION

It is a principal object of the invention to eliminate the use of explosives to activate the perforating apparatus. It is an object of the invention to eliminate the use of an electric wireline or a slickline to lower a perforator into a well through a tubing string. Another object is to eliminate the need to retrieve a perforator before the tubing string can be pulled from a well. This invention is a manually-dropped non-explosive perforating apparatus which achieves these and other objects.

BRIEF DESCRIPTION OF THE DRAWINGS

In the drawings, closely related figures have the same number but different alphabetic suffixes.

REFERENCE NUMERALS IN DRAWINGS

Figure 1:
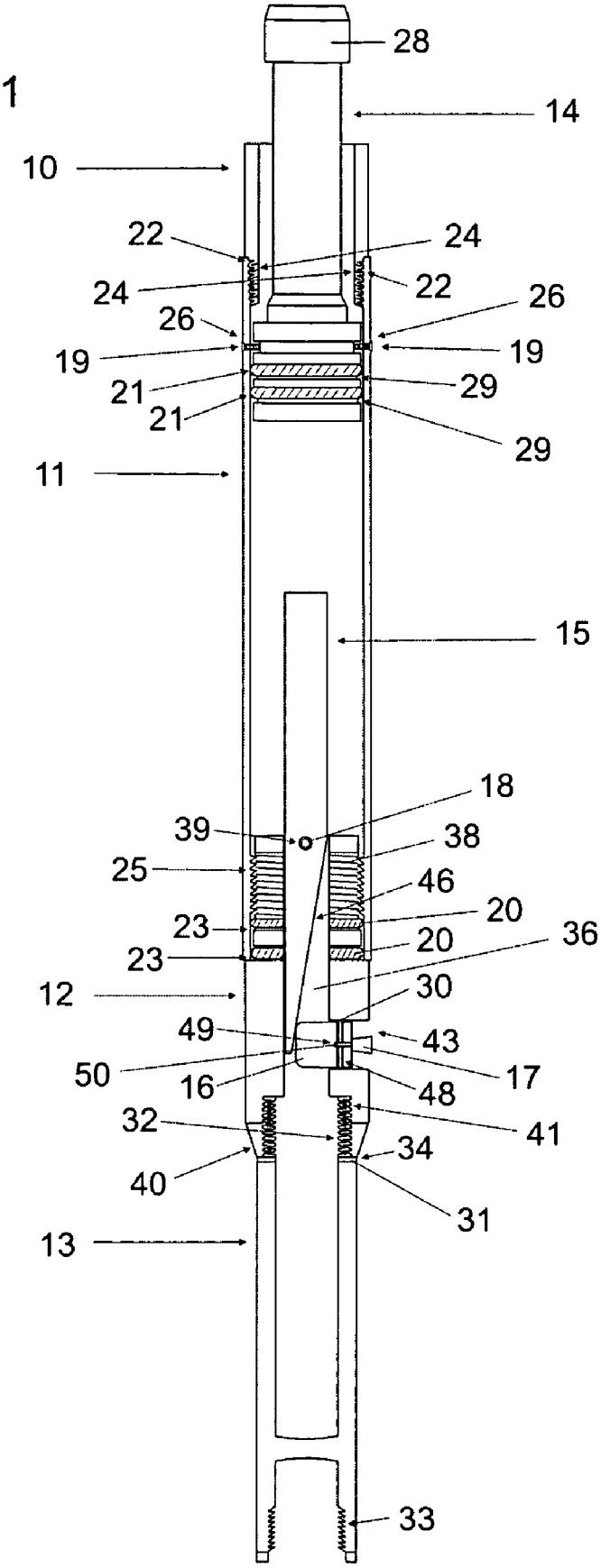
FIG. 1 shows perforating apparatus in a side elevation cutaway view prior to activation of apparatus.

| | |
|---|---|
| 10 | hollow metal pipe |
| 11 | hollow metal chamber |
| 12 | wedge holder |
| 13 | wedge stop |
| 14 | drive disc |
| 15 | drive wedge |
| 16 | piston |
| 17 | metal button |
| 18 | frangible pin |
| 19 | metal shear screws |

-continued

| | |
|---|---|
| 20 | wedge holder O-ring |
| 21 | drive disc O-ring |
| 22 | upper threading on hollow pipe |
| 23 | groove in wedge holder |
| 24 | upper threading on chamber |
| 25 | lower threading on chamber |
| 26 | upper holes in chamber |
| 28 | fishing neck |
| 29 | drive disc grooves |
| 30 | piston O-ring |
| 31 | wedge stop O-ring |
| 32 | upper exterior threading on wedge stop |
| 33 | lower interior threading on wedge stop |
| 34 | wedge stop groove |
| 36 | vertical hole in wedge holder |
| 38 | upper end threading on wedge holder |
| 39 | frangible pin hole |
| 40 | tapered lower end |
| 41 | interior threading on wedge holder |
| 43 | lateral hole in wedge holder |
| 44 | series of holes in wedge holder |
| 45 | series of frangible pin |
| 46 | drive wedge acute angle |
| 48 | piston groove |
| 49 | hole in piston |
| 50 | button pin |

DETAILED DESCRIPTION OF THE PREFERRED EMBODIMENT

These and other specific objects of the present invention provide one or more of the following desirable features not heretofore known or used. Such features will be apparent from the following descriptive matter when taken in conjunction with the drawings.

1. A non-explosive perforating apparatus, requiring no explosive charge, wherein perforator is dropped by hand into a tubing string of a well and an impact bar is dropped into the tubing string. The impact bar shears screws on drive disc causing hydraulics to move drive disc down onto drive wedge, or onto fluid in a wedge holder, when the perforator reaches the appropriate point. The drive wedge, or the fluid, moves piston and metal button causing button to penetrate tubing. Tubing can then be removed without fluid being retained within.

2. A non-explosive perforating apparatus, unarmed, posing no danger to store, transport, and use because it does not require a detonator and charge, rather is hydraulically or fluid activated.

3. A non-explosive perforating apparatus which stays in a tubing string until the drained tubing string is removed from a well at which time the activated tool can be recovered.

4. A non-explosive perforating apparatus hydraulically-activated with four or fewer moving parts.

5. A non-explosive perforating apparatus that requires no worker safety training and no special handling for storage and transporting required for use of perforators that use an explosive charge and detonator.

6. A non-explosive perforating apparatus of a simple design which saves time and expense due to reliability of use, permitting producing wells to be serviced and returned to production mode in the least possible time.

These and other specific objects will be apparent from the following descriptive matter when taken in conjunction with the drawings.

Description—FIG. 1—Preferred Embodiment

Referring to FIG. 1, a drawing showing the primary embodiment of the apparatus in a side elevation cutaway view prior to hydraulic-activation of apparatus.

The body of this non-explosive sealed hydraulically-activated perforating apparatus consists of five main sections machined from cylindrical metal pipes and cylindrical metal bars of varying lengths and three parts inside the body of the apparatus machined from metal.

Top section of apparatus is hollow metal pipe 10 threaded 22 on exterior at bottom of pipe 10. Pipe 10 has a slightly smaller inside diameter (I.D.) than second section of apparatus. Pipe 10 screws into hollow metal chamber 11.

Second section of apparatus is hollow metal chamber 11 threaded 24 at upper end and lower end 25 of interior. Bottom of pipe 10 screws into top of chamber 11. Interior of chamber 11 is chrome steel or similar finished steel permitting drive disc 14 to move smoothly inside chamber 11. Chamber 11 is screwed into wedge holder 12.

Third section of apparatus is wedge holder 12, a machined length of metal bar threaded 38 on exterior at top. Wedge holder 12 is machined with the following features:

- a hole 36 of uniform diameter drilled vertically through length of wedge holder 12;
- upper and lower grooves 23 on outside diameter of wedge holder 12 below threaded upper end 38 are designed to accept wedge holder O-rings 20;
- frangible pin hole 39 through upper end of wedge holder 12 above threading 38, to accept frangible pin 18;
- tapered lower end 40 to meet small diameter of wedge stop 13;
- tapered lower end 40 threaded on interior 41 to accept wedge stop 13;
- interior groove 23 to accept wedge holder O-ring 20 below interior threaded portion 38 of wedge holder 12;
- lateral hole 43 machined laterally through exterior wall ending at interior vertical hole 36, to accept piston 16; and
- series of small holes 44 drilled into wedge holder 12 to end in lateral hole 43 to allow series of frangible pins 45 to be inserted to secure piston 16 into wedge holder 12. (See FIGS. 2 and 3)

Lower chamber threading 25 on interior at bottom end of hollow metal chamber 11, permits chamber 11 to be secured to upper end of wedge holder 12. A series of chamber holes 26 are spaced near top of chamber 11 at equal intervals around chamber 11 and immediately below interior upper threading 24. Upper holes 26 accommodate metal shear screws 19 needed to secure chamber 11 to lower end of drive disc 14.

The fourth main section is wedge stop 13 that attaches to wedge holder 12. Wedge stop 13 is machined solid metal bar, threaded on exterior 32 at top end and interior 33 at bottom end. Wedge stop groove 34 is machined immediately below exterior threading 32 to accept wedge stop O-ring 31. Upper portion of wedge stop 13 is drilled vertically to create a receiving area for drive wedge 15 upon activation of perforator.

Drive disc 14 is machined solid metal bar with sufficient tolerances to fit into I.D. of upper portion of hollow metal chamber 11. To prohibit drive disc 14 from being withdrawn from chamber 11, uniform I.D. of chamber 11 is slightly larger than I.D. of upper hollow metal pipe 10.

Drive disc 14 is further machined with sufficient grooves 29 near its bottom end to accept two or more drive disc O-rings 21 and multiple metal shear screws 19. A sealed section is created when drive disc O-rings 21 are in place in grooves 29 in drive disc 14. Lower end of drive disc 14 is machined to prevent disc 14 from traversing through upper hollow metal pipe 10.

Top of drive disc 14 is machined to form fishing neck 28. Fishing neck 28, upper portion of drive disc 14, traverses through I.D. of pipe 10. Fishing neck 28 extends above pipe 10 before apparatus is activated. Drive disc grooves 29 for drive disc O-rings 21 is immediately below upper hollow pipe threading 22.

Drive wedge 15 is machined length of cylindrical solid metal. Lower end of drive wedge 15 is machined to an acute angle 46. Frangible pin hole 39 is drilled through wedge 15 immediately above angle 46 to accept a frangible pin 18. Drive wedge 15 is inserted and secured in wedge holder 12 so that angle 46 on wedge 15 can rest on interior end of piston 16.

Piston 16, a small solid metal bar is machined to fit into lateral hole 43 in wedge holder 12. Piston 16 machined with groove 48 immediately below top of piston 16 to accommodate piston O-ring 30. Small hole 49 is drilled into upper end of piston 16 to accept metal button 17. (See FIG. 2)

Metal button 17, a small round piece of solid metal machined with one end slightly bigger than the other, fits into top of piston 16. Button pin 50 extends from center of button 17, at bottom of button 17, for insertion into piston 16. Button 17 is shaped with one end slightly larger than the other. (See FIG. 2)

Figure 2:
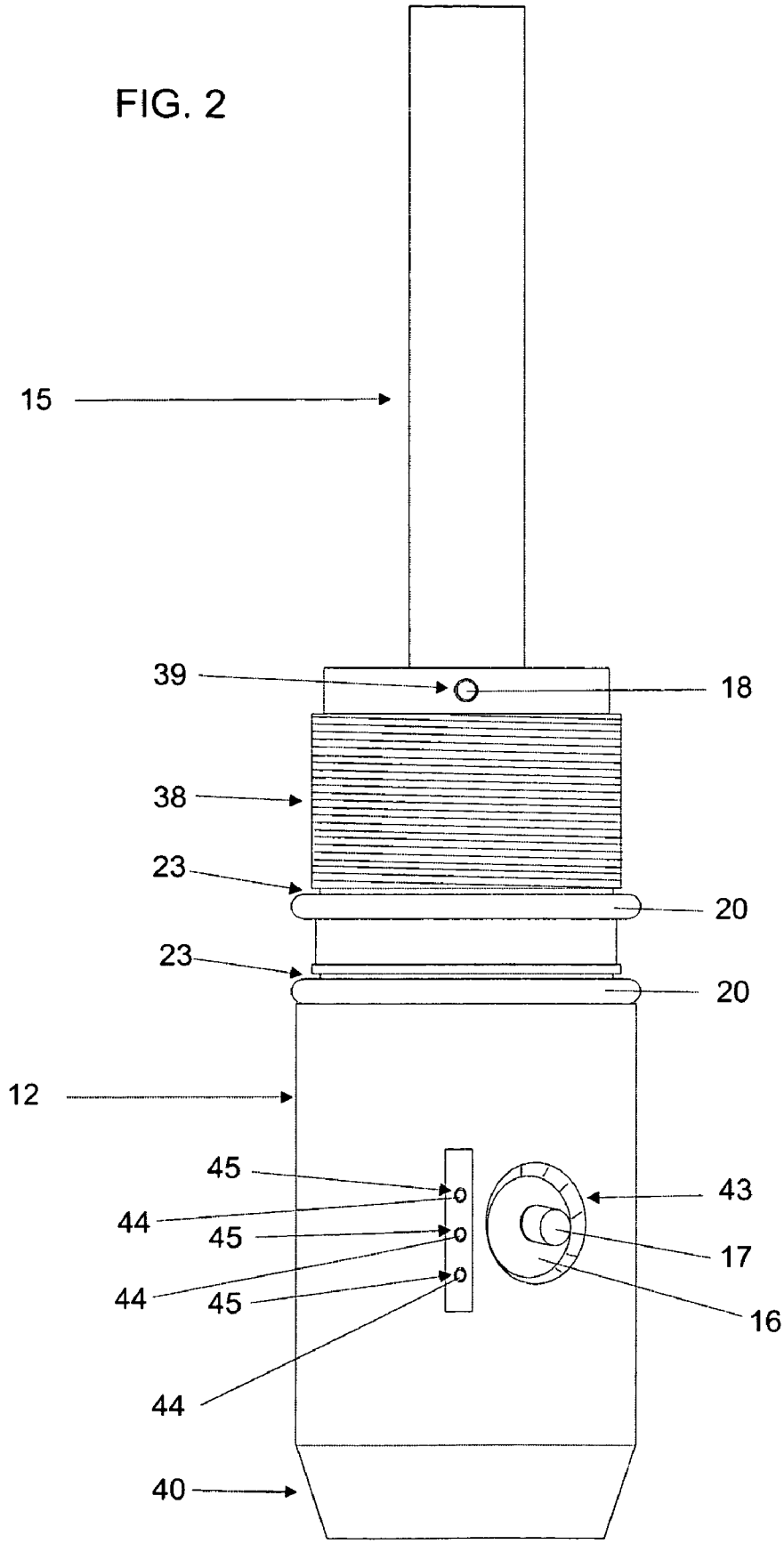
FIG. 2 shows a side elevation view of wedge holder of the perforating apparatus with drive wedge, piston, and button shown prior to activation.

Description—FIG. 2—Preferred Embodiment

Referring to FIG. 2, a side elevation view showing wedge holder and drive wedge of perforating apparatus with drive wedge shown prior to activation of apparatus.

Wedge holder 12 contains drive wedge 15 positioned to extend above wedge holder 12. Wedge holder grooves 23 are machined on outside diameter of wedge holder 12 immediately below threaded upper end 38. Frangible pin 18 is located in frangible pin hole 39 above threading 38. Wedge holder 12 has tapered lower end 40.

Lateral hole 43 of wedge holder 12 is machined laterally through exterior wall with a larger I.D. at outside of hole 43, to accept piston 16 into wedge holder 12. A series of small holes 44 in wedge holder 12 for series of frangible pins 45 drilled at an angle in wedge holder 12.

Piston 16, a small piece of a metal bar, is machined to fit into lateral hole 43 in wedge holder 12. Piston 16 is machined with groove 48 immediately below exterior end of piston 16 to accommodate piston O-ring 30. A small hole 49 is drilled into piston 16 to accept button 17. When piston 16 moves outward piston O-ring 30 will not hold pressure because wedge holder 12 has a larger I.D. than piston, the very small difference is sufficient to blow piston O-ring 30 off of piston 16.

Button 17 is machined to fit onto exterior end of piston 16. Button pin 50 extends from center of button 17 at interior end and inserted into piston 16. Button 17 is slightly larger at its exterior end.

Figure 3:
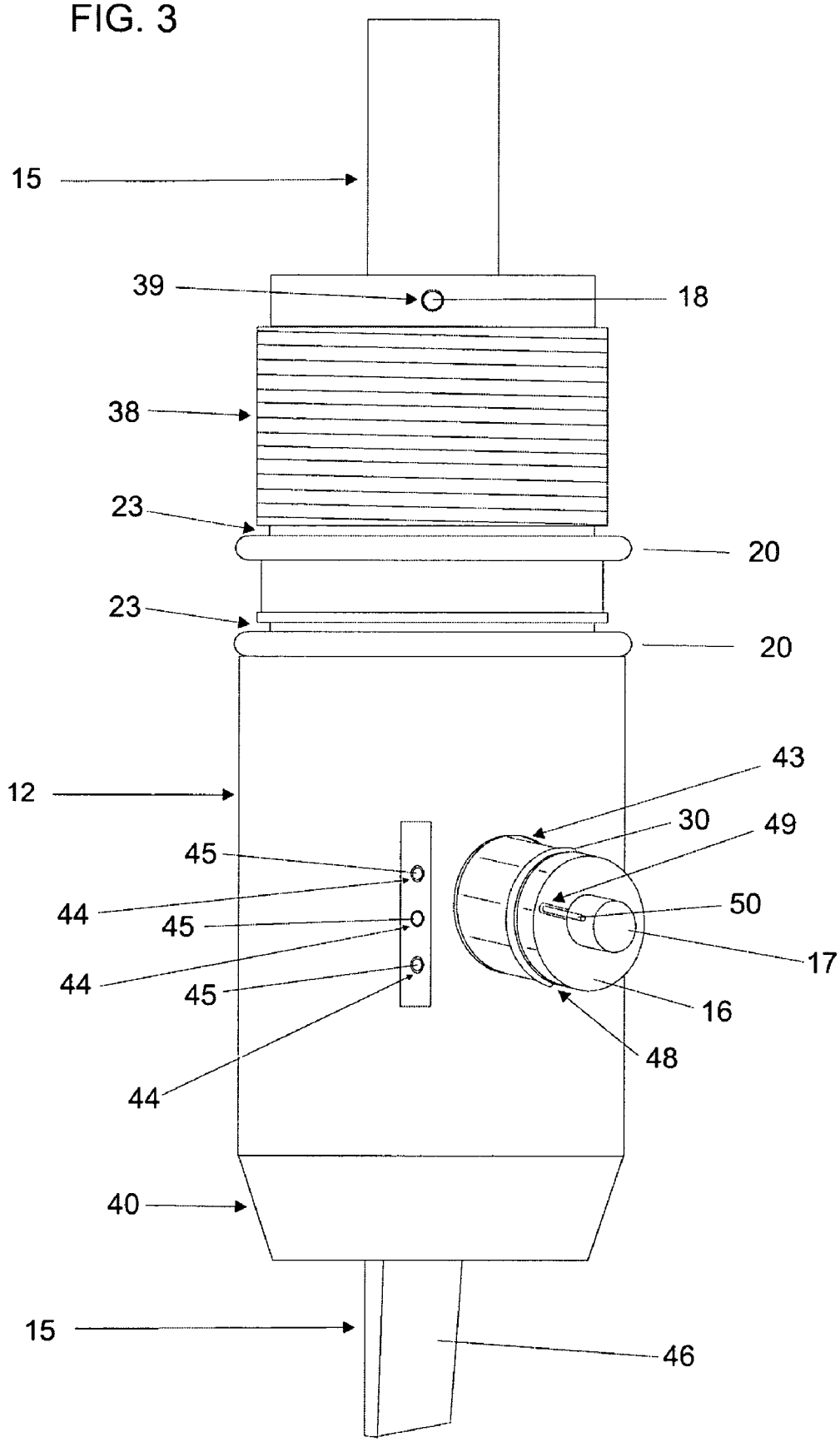
FIG. 3 shows a side elevation view of wedge holder of the perforating apparatus with drive wedge, piston, and button shown following hydraulic activation.

Description—FIG. 3—Preferred Embodiment

Referring to FIG. 3, a side elevation view showing wedge holder and drive wedge after activation of apparatus.

Piston 16 and metal button 17 are shown in position after acute angle 46 of drive wedge 15 has contacted piston 16 and expelled button 17 laterally from lateral hole 43 in wedge holder 12.

Alternative Activation Method

Referring to FIGS. 1, 2, and 3, when fluid-activation alternative is used, drive wedge 15 is not needed.

Operations (See FIG. 1) Activation of preferred embodiment of present invention is accomplished when an impact bar is manually dropped onto drive disc 14. This force causes screws 19 in drive wedge 15 to shear. When sheared, drive wedge 15, or alternatively fluid, is driven downward into vertical hole 36 of wedge holder 12 by hydraulics from well causing drive disc 14 to strike drive wedge 15, or alternatively fluid, and break frangible pin 18 which had secured drive wedge 15 in wedge holder 12.

Prior to hydraulic activation, drive wedge acute angle 46 rests behind piston 16. (See FIG. 2). Downward force created when activating apparatus causes acute angle 46 of drive wedge 15, or alternatively fluid-activation, to move piston 16 and metal button 17 laterally from lateral hole 43. This creates a hole in well tubing. Drive wedge 15 continues down vertical hole 36 onto wedge stop 13. (See FIG. 3).

While the above description contains many specificities, these should not be construed as limitations on the scope of this invention, but rather as an exemplification of the primary embodiment. Other variations are possible, several of which are detailed in a previous section.

CONCLUSION, RAMIFICATIONS, AND SCOPE

Accordingly, it can be seen the Non-Explosive Tubing Perforator takes away the danger of perforating tubing with explosives. The combination of this safe technology and its methods of use facilitate the speed and reliability of the perforating process.

Although the description above contains many specificities, these should not be construed as limiting the scope of the invention, but as merely providing illustrations of some of the presently preferred embodiments of this invention. For example, the cylindrical metal pipes used to manufacture the perforating apparatus can vary in diameter and length to adapt to varying situations.

Thus the scope of the invention should be determined by the appended claims and their legal equivalents, rather than by the examples given.

What is claimed is:

1. A non-explosive perforating apparatus for perforating tubing in a well, comprising a hydraulically-activated perforating assembly, sealed with O-rings and frangible pins and comprised of machined cylindrical lengths of metal pipe and cylindrical-metal bars including (a) a hollow metal pipe with exterior threading at its bottom end;

(b) a metal chamber machined from a cylindrical metal pipe with a finished steel interior and interior threading at both ends, and a uniform inside diameter slightly larger than inside diameter of said hollow metal pipe;

(c) a wedge holder machined from a cylindrical metal bar disposed to accept a drive wedge and comprising:
exterior threading at top, a hole drilled vertically through length of said wedge holder, a series of grooves on exterior below said threading disposed to accept O-rings at top, a frangible pin hole at upper end disposed to accept a frangible pin, a tapered lower end with interior threading, a groove to accept an O-ring above said interior threading, a lateral hole through wall of said wedge holder above said tapered lower end to receive a piston, said lateral hole having a slightly larger inside diameter at its outside, a difference sufficient to blow off a piston O-ring, and a series of small holes ending in said lateral hole disposed to allow insertion of frangible pins;

(d) a wedge stop machined from a cylindrical metal bar disposed to receive a drive wedge comprising: an area drilled vertically through upper portion, exterior threading at top end to accept said wedge holder, a groove below said exterior threading to accept an O-ring and interior threading at bottom end;

(e) a drive wedge machined from a cylindrical metal bar, comprising: an acute angle at its lower end and a hole drilled immediately above said acute angle to accept a frangible pin for securing said drive wedge to said wedge holder;

(f) a drive disc machined from a cylindrical metal bar, with lower end machined to prevent said drive disc from traversing through said hollow metal pipe, and disposed to extend above said upper hollow metal pipe prior to activation of said apparatus, comprising:

tolerances to fit inside diameter of upper portion of said hollow metal chamber, grooves near bottom of said drive disc to accept O-rings and metal shear screws, grooved at its bottom end to receive O-rings, disposed to receive force from an impact bar on its top, and a fishing neck at top of said drive disc for suspension from a wireline, if needed;

(g) a piston machined from a small piece of a metal bar to fit into lateral hole in said wedge holder, disposed to allow a frangible pin to be inserted to secure said piston to said wedge holder, said piston comprising a groove disposed to accommodate said O-ring near outer end of said piston and a small hole at outer end of said piston;

(h) a metal button slightly larger at exterior end, disposed to fit into said small hole in said piston and having a button pin extending outward from center of said metal button.

2. The non-explosive perforating apparatus for perforating tubing of claim 1, wherein said perforating apparatus is activated when:

(a) force of a bar impacts said drive disc which shears screws allowing said disc to release down on said drive wedge inside said apparatus, (b) hydraulics created by well fluids within said apparatus moves said drive disc onto said drive wedge impacting said piston, and (c) impact on said piston expels said metal button from the wall of said apparatus creating a drain hole in said well tubing.

3. The non-explosive perforating apparatus for perforating tubing of claim 1, wherein said perforating apparatus is fluid-activated, without said drive wedge, when:

(a) force of a bar impacts said drive disc which shears screws allowing said disc to release down on fluid in said wedge holder, and (b) hydraulics created by said fluid within said apparatus impacts said piston and expels said metal button from wall of said apparatus creating a drain hole in said well tubing.

4. A method for perforating tubing inside a casing string using the non-explosive perforating apparatus of claims 1 or 3 comprising the steps of:

(a) positioning said apparatus at top of a tubing string, (b) manually dropping said apparatus through said tubing string allowing it to hit an obstruction or plugged area in said tubing, (c) dropping an impact bar through said tubing string causing a collision with said apparatus to activate said apparatus, and (d) recovering said apparatus and impact bar from said tubing string after said tubing has been removed from a well.

* * * * *